US006915950B1

(12) United States Patent
Legerstee

(10) Patent No.: US 6,915,950 B1
(45) Date of Patent: Jul. 12, 2005

(54) DEVICE AND METHOD FOR CHRONIC WOUND CONDITION TREATMENT

(75) Inventor: Ronald Legerstee, Buitenkruierstraat (NL)

(73) Assignee: Johnson & Johnson Medical, Arlington, TX (US)

( * ) Notice: Subject to any disclaimer, the term of this patent is extended or adjusted under 35 U.S.C. 154(b) by 0 days.

(21) Appl. No.: 09/427,292

(22) Filed: Oct. 26, 1999

(51) Int. Cl.[7] ..... G06G 1/02

(52) U.S. Cl. ..... 235/70 A; 235/70 R; 235/70 B; 235/70 C

(58) Field of Search ..... 235/70 R, 70 A, 235/70 B, 70 C

(56) References Cited

U.S. PATENT DOCUMENTS

| | | | | |
|---|---|---|---|---|
| 3,570,757 A | | 3/1971 | Wells | |
| 3,747,847 A | | 7/1973 | Cohen | |
| 3,814,308 A | | 6/1974 | Kolan | |
| 3,817,102 A | * | 6/1974 | Shea | 73/338 |
| 4,189,634 A | | 2/1980 | LaBove et al. | |

* cited by examiner

*Primary Examiner*—Karl D. Frech

(57) ABSTRACT

A device and method for chronic wound treatment is disclosed. The device is in the form of a slide rule which instructs the user regarding a recommended course of treatment based on the healing phase condition and moisture condition of the wound.

11 Claims, 7 Drawing Sheets

(2 of 7 Drawing Sheet(s) Filed in Color)

DEVICE AND METHOD FOR CHRONIC WOUND CONDITION TREATMENT

BACKGROUND OF THE INVENTION

1. Field of the Invention

This invention is concerned with a device and the method of using such device to prescribe a treatment regiment based on the condition of the wound, particularly when the wound is a chronic wound, most particularly pressure ulcers (sores), venous ulcers and diabetic ulcers.

2. Related Art

The healing process of wounds is widely accepted to be categorized into the following four (4) conditions (hereinafter referred to as "healing phase conditions"):

(1) necrotic; (2) fibrinous slough or infection; (3) granulation; and (4) epithelialization. The necrotic condition refers to the wound healing phase condition where catabolic processes have been resulting in dead tissue. The fibrinous slough or infection condition refers to the circumstance where the wound is in the inflammatory phase, where dead cellular debris fills the base of the wound with an off-white to yellow layer. The granulation condition refers to the healing phase when the wound has reached the proliferative stage of healing and when the wound cavity is slowly filled with the "repair-material" of the body which consists of fibro-vascular tissue and is called granulation. The epithelialization condition describes the wound healing phase wherein the keratinocytes (epidermal cells) are dividing and gradually crossing the wound surface from the margins towards the opposite side. Once the cells make contact with each other the cells stop dividing (contact inhibition).

The foregoing healing phase conditions have also been depicted by a widely accepted color classification scheme with the necrotic condition depicted by the color black; the fibrinous slough or infection condition depicted by the color yellow; the granulation condition shown by the color red; and the epithelialization condition depicted by the color pink.

A second condition important in the healing process of the wound is the wound's moisture condition or level (hereinafter referred to as "moisture condition"). It has been identified as early as 1962 (see Winter, "Formation of the Scab and the Rate of Epithelialization in the Skin of the Domestic Pig", Nature; 193: 293–294 (1962) that wound healing occurs faster in a "moist" environment as opposed to a dry or wet environment. If the environment is too dry, it is believed that the wound does not heal as quickly because in a healing wound, most of the processes involved are driven by cells (e.g., specific leucocytes such as Poly Morpho Nuclear's (PMN's)). These cells need a moist environment to stay alive for their biological work. When the wound is too wet, maceration of the skin cells occurs which cause cell death by the cells literally bursting from taking up too much fluid.

The moisture condition of the wound has also been depicted by color schemes with the color yellow depicting the dry condition (yellow conjuring up the impression of the dryness of the desert); the color blue being used to depict the wet condition (blue conjuring up the image of the wetness of the ocean); and the color green being used to represent the moist condition (green conjuring the likeness of an oasis).

The foregoing healing phase conditions and moisture conditions with the described color schemes and recommended wound treatment have been depicted in graphical form in the copyrighted and trademarked drawing entitled "The Natural Line of Wound Healing" provided by Johnson & Johnson. {See FIG. 6} This conceptual model visualizes the way in which the healing process takes place in chronic wounds. Specifically, the "S-shaped" curve of the graph depicts the healing phase condition of the wound with the lower left-hand part of the curve representing the necrotic phase (darkened area appearing black); moving along the curve upwards, the yellow region representing the sloughy healing phase; moving yet further up the curve -and crossing over the horizontal green line, the red region of the curve representing the granulation healing phase; and continuing up the curve to the pink region representing the epithelialization phase of the wound. Likewise, the wet or macerated condition of a wound is illustrated by the blue region under the horizontal green line. The horizontal green line representing the ideal "moist" wound moisture level. Above the green line, is the dry (dehydrated) region depicted by the color yellow. While this graph provides a useful and illustrative tool in assessing the healing phase and moisture conditions of the wound and prescribing a wound treatment regiment, a more simplified tool was desired.

The present invention makes use of a "slide rule format" as hereinafter described to provide a simple and illustrative method of determining the treatment regiment based on the healing phase condition and moisture condition for the wound.

Slide rule formats have been known to assist in calculations and to produce many things including the manufacture of springs (see U.S. Pat. No. 3,570,757); estimates for concrete mix proportions of air, cement, water, fine and coarse aggregates (see U.S. Pat. No. 3,814,308); guidelines for intravenous therapy (see, U.S. Pat. No. 3,747,847); and for computing hyper-alimentation dosages (see, U.S. Pat. No. 4,189,634). However, Applicants are unaware of the use of any slide rule format based on the healing phase and moisture conditions of chronic wounds for the purpose of following a treatment regiment for such wounds.

BRIEF DESCRIPTION OF THE DRAWINGS

The patent or application file contains at least one drawing executed in color. Copies of this patent with color drawing(s) will be provided by the Patent and Trademark Office upon request and payment of necessary fees.

SUMMARY OF THE INVENTION

Figure 1:
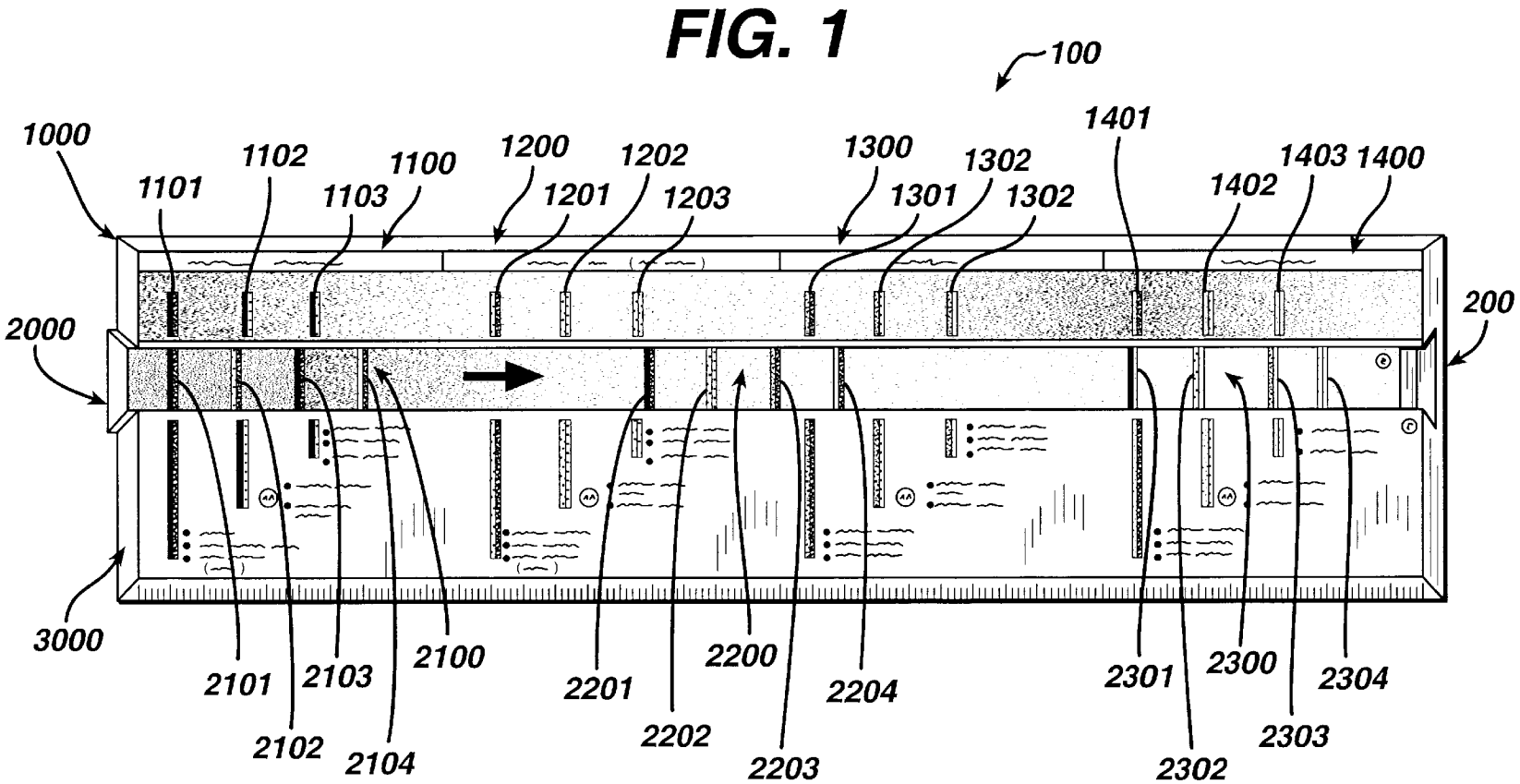
FIG. 1 depicts an overview of the device of this invention.

This invention relates to a device comprising a sliding member and a fixed member, the sliding member indicative of the moisture condition of a wound and the fixed member indicative of the healing phase condition of a wound and containing instructions as to the wound treatment regiment resulting from the alignment of particular wound moisture condition with a particular wound healing phase condition.

In a preferred embodiment the device comprises:

(a) a base comprising first and second elongated fixed members, the members being spaced to receive a moveable slide;

(b) the moveable slide being located between the two spaced elongated fixed members;

(c) the first of the elongated fixed members separated into regions indicating the healing phase condition of the wound in terms of whether the wound is in the necrotic condition; fibrinous slough or infection condition; granulation condition; or epithelialization condition; each of these healing phase condition regions further containing indicators corresponding to the moisture condition of the wound indicating whether the moisture level of the wound is in the wet condition; moist condition, or dry condition;

(d) the moveable slide being separated into three regions corresponding to the moisture condition of the wound in terms of whether the wound is in the wet condition, moist condition, or dry condition; each of these moisture condition regions further containing wound healing phase indicators corresponding to the healing phase condition of the wound in terms of whether the wound is in the necrotic condition; fibrinous slough or infection condition, granulation condition; or epithelialization condition; and (e) the second of the elongated fixed members comprising treatment descriptors comprising instructions for wound treatment regiments corresponding to the wound phase healing and moisture conditions which result from the alignment of the healing and moisture condition indicators of the first elongated fixed member with the healing phase and moisture condition indicators of the moveable slide.

This invention also relates of a method for prescribing a treatment regiment for a wound comprising the steps of:

(a) assessing the wound healing phase condition;

(b) assessing the wound moisture condition;

(c) providing a device comprising at least two fixed members and a sliding member, the first of the fixed members representing the wound healing condition, the sliding member representing the wound moisture condition, and the second of the fixed members comprising wound treatment instructions;

(d) aligning the moisture condition of the sliding member with the wound healing phase condition of the fist fixed member corresponding to the assessed wound healing phase and moisture condition and then prescribing the wound treatment regiment indicated on the second fixed member resulting from the alignment of the sliding member and the first fixed member.

DETAILED DESCRIPTION OF PREFERRED EMBODIMENTS OF THE INVENTION

Embodiments of the present invention and the advantages thereof are best understood by referring to the following descriptions and drawings, wherein like numerals are used for like and corresponding parts of the drawings.

In a general embodiment, the present invention relates a device comprising a sliding member and a fixed member, the sliding member indicative of the moisture condition of a wound and the fixed member being indicative of the healing phase condition of a wound and containing instructions as to the wound treatment regiment resulting from the alignment of the sliding member's particular wound moisture condition with the fixed member's wound healing phase condition.

Of course, an alternate embodiment is one where the device's sliding member is indicative of the wound's healing phase condition and the fixed number is indicative of the wound's moisture condition. In either embodiment, wound treatment instructions result by aligning the assessed moisture condition and healing phase condition indicators.

FIG. 1 is an overall representation of a preferred embodiment of the device 100 of this invention.

Device 100 comprises base 200 comprising a first elongated fixed number 1000 and a second elongated fixed number 3000. A moveable slide 2000 is located between elongated fixed numbers 1000 and 3000.

Elongated fixed number 1000 is separated into four (4) regions indicating the healing phase condition of the wound such as the necrotic tissue condition region 1100; the fibrinous slough or infection condition region 1200; the granulation condition region 1300; and the epithelialization condition region 1400. Each of these four regions contain indicators corresponding to the moisture condition of the healing condition. Thus, necrotic tissue condition region 1100 has indicator 1101 to designate a wet wound, indicator 1102 to indicate a moist wound, and indicator 1103 to indicate a dry wound; the fibrinous slough or infection condition region 1200 has indicator 1201 to indicate a wet wound, indicator 1202 to indicate a moist wound, and indicator 1203 to indicate a dry wound; the granulation condition region 1300 has indicator 1301 to indicate a wet wound, and indicator 1302 to indicate a moist wound, indicator 1303 to indicate a dry wound; and the epithelialization condition region 1400 has indicator 1401 to indicate a wet wound, indicator 1402 to indicate a moist wound, and indicator 1403 to indicate a dry wound.

In a preferred embodiment the healing phase conditions 1100, 1200, 1300, and 1400 are shaded to indicate the distinctness of the regions, and most preferably the regions are shaded in color, with varying intensities of color as one progresses from the necrotic condition region 1100, depicted by the color black, to the infection condition region 1200 depicted by the color yellow, to the granulation region 1300 depicted by the color red and to the epithelialization region 1400 condition depicted by the color pink.

Also in a preferred embodiment, the indicators of the wound moisture condition are shaded to indicate the distinctness of the wound moisture content wherein the wet condition is indicated by the color blue, the moist condition indicated by the color green, and the dry condition indicated by they color yellow.

In a more preferred embodiment, indicators 1101 to 1103, 1201 to 1203, 1301 to 1303, and 1401 to 1403 are comprised of two side-by-side colored bars indicated by Table 1.

TABLE 1

| Indicator | Left Colored Bar | Right Colored Bar |
|---|---|---|
| 1101 | Black | Blue |
| 1102 | Black | Green |
| 1103 | Black | Yellow |
| 1201 | Yellow | Blue |
| 1202 | Yellow | Green |
| 1203 | Yellow | Yellow |
| 1301 | Red | Blue |
| 1302 | Red | Green |
| 1303 | Red | Yellow |

TABLE 1-continued

| Indicator | Left Colored Bar | Right Colored Bar |
|---|---|---|
| 1401 | Pink | Blue |
| 1402 | Pink | Green |
| 1403 | Pink | Yellow |

Movable slide 2000 is separated into three (3) regions corresponding indicating the three moisture conditions of a wound such as the wet condition region 2100, the moist condition region 2200, and the dry condition region 2300. Each of these three regions contain indicators corresponding to the healing condition of the wound. Thus, wet condition region 2100 has indicator 2101 to designate a necrotic wound, indicator 2102 to designate a fibrinous slough or infection condition wound, indicator 2103 to designate a granulating wound, and indicator 2104 to designate an epithelializing wound; moist condition region 2200 has indicator 2201 to designate a necrotic wound, indicator 2202 to designate a infected wound, indicator 2203 to designate a granulating wound, and indicator 2204 to designate an epithelializing wound; and dry condition region 2300 has indicator 2301 to designate a necrotic wound, indicator 2302 to designate an infected wound, indicator 2303 to designate a granulating wound, and indicator 2304 to designate an epithelializing wound.

In a preferred embodiment, moisture condition regions 2100, 2200, and 2300 are shaded to indicate the distinctness of the regions, and most preferably the regions are shaded in color, with varying intensities of color as one progresses from the wet condition region 2100 depicted by the color blue, to the moist condition region 2200 indicated by the color green, and to the dry condition region 2300 indicated by the color yellow. Additionally, arrows may be placed on movable slide 2000 to direct the user to the ideal moisture level condition of "moist", i.e., region 2200, as depicted in FIG. 1.

Also in a preferred embodiment, the indicators of the wound healing condition are shaded to indicate the distinctness of the wound healing phase condition wherein the necrotic condition is indicated by the color black, the sloughy tissue or infection condition is indicated by the color yellow, the granulating condition is indicated by the color red, and the epithelializing condition is indicated by the color pink.

In a more preferred embodiment, indicators 2101 to 2104, 2201 to 2204, and 2301 to 2304 are comprised of two side-by-side colored bars indicated by TABLE 2.

TABLE 2

| Indicator | Left Colored Bar | Right Colored Bar |
|---|---|---|
| 2101 | Black | Blue |
| 2102 | Yellow | Blue |
| 2103 | Red | Blue |
| 2104 | Pink | Blue |
| 2201 | Black | Green |
| 2202 | Yellow | Green |
| 2203 | Red | Green |
| 2204 | Pink | Green |
| 2301 | Black | Yellow |
| 2302 | Yellow | Yellow |
| 2303 | Red | Yellow |
| 2304 | Pink | Yellow |

Elongated fixed member 3000 contains the written description of the wound and prescribed wound treatment regiment based on alignment of the healing and moisture condition of the wound (i.e., from alignment of indicators of fixed member 1000 and movable slide 2000).

In a prereferred embodiment fixed number 3000 is separated or contains groupings of wound descriptions and prescribed wound treatment regiments based on the four (4) wound healing phase conditions (i.e., necrotic; fibrinous slough (infection); granulation; and epithelialisation.)

Figure 2:
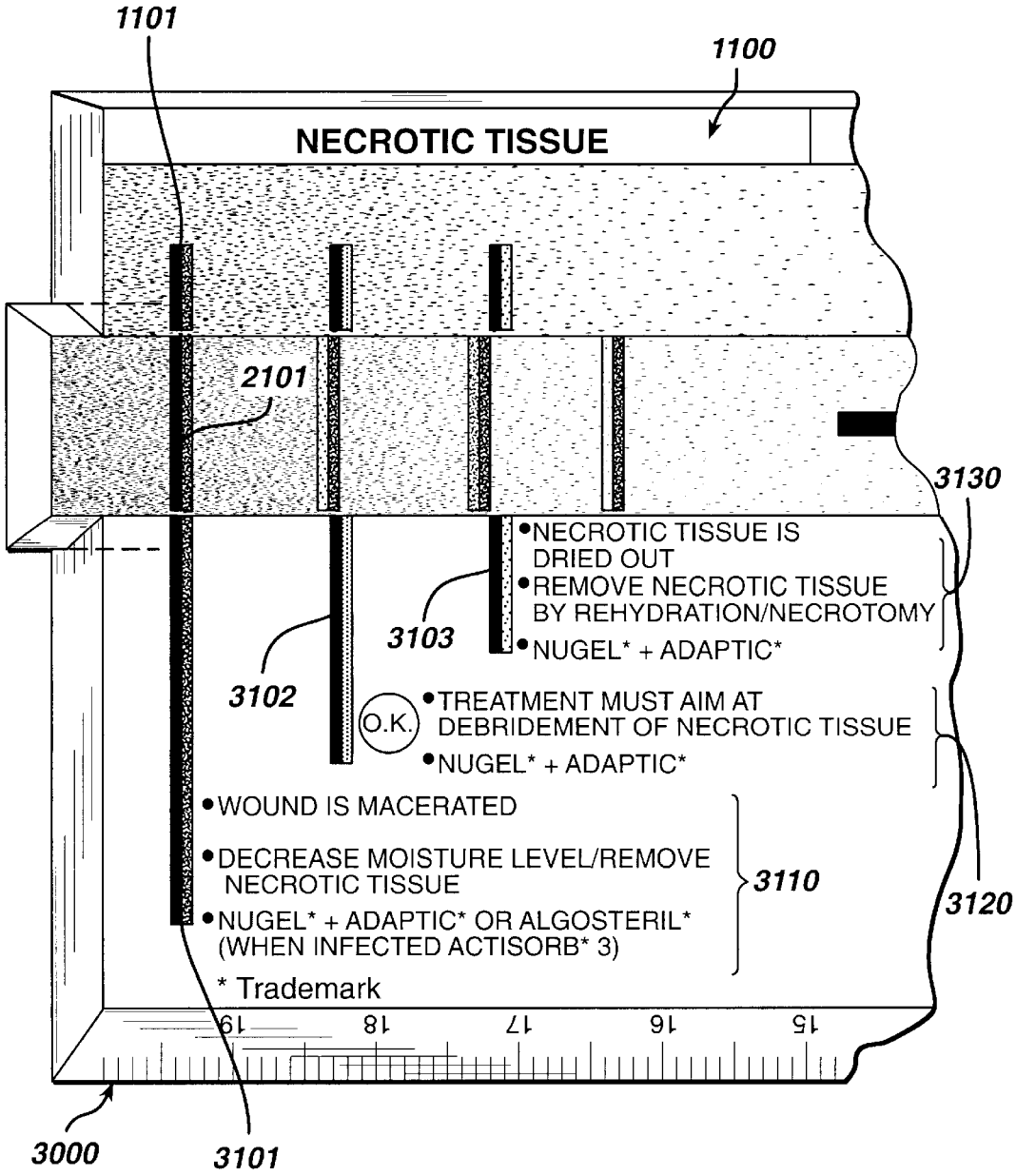
FIG. 2 depicts an enlargement of the device of this invention concerning the treatment regiment for wounds in the necrotic tissue condition.

Referring to FIG. 2 which relates to the necrotic tissue condition, fixed member 3000 contains indicators 3101, 3102, and 3103. Indicator 3101 refers to a wound in the necrotic and wet condition and nearby contains treatment descriptor 3110 which describes the healing and moisture condition of the wound along with the prescribed treatment. Thus treatment descriptor 3110 describes the wound as being macerated, recommends the treatment of decreasing moisture level and/or removing necrotic tissue, and recommends particular wound care dressings suitable for such treatment and in this instance Johnson & Johnson wound care dressings of NUGEL (generically, a hydrogel with alginate dressing) with ADAPTIC (generically, a non-adherent impregnated wound dressing) or ALGOSTERIL (generically, a calcium alginate dressing) or when the wound is infected ACTISORB 3 (generically, an activated charcoal dressing with silver). Treatment descriptor 3120 located near indicator 3102, describes the wound condition as being OK and recommends debridement of any necrotic tissue along with use of Johnson & Johnson NUGEL and ADAPTIC dressings. Finally, treatment descriptor 3130, located near indicator 3103, describes the necrotic tissue as being dried out and recommends removal of necrotic tissue and dehydration of the wound along with use of Johnson & Johnson NUGEL and ADAPTIC dressing.

In operation, the depiction of FIG. 2 demonstrates the alignment of indicators 1101, 2101 and 3101 which indicate the treatment regiment under treatment descriptor 3110 for a wound in a necrotic healing condition and a wet moisture condition. Similarly, alignment of the other indicators demonstrate appropriate treatment regiment.

Figure 3:
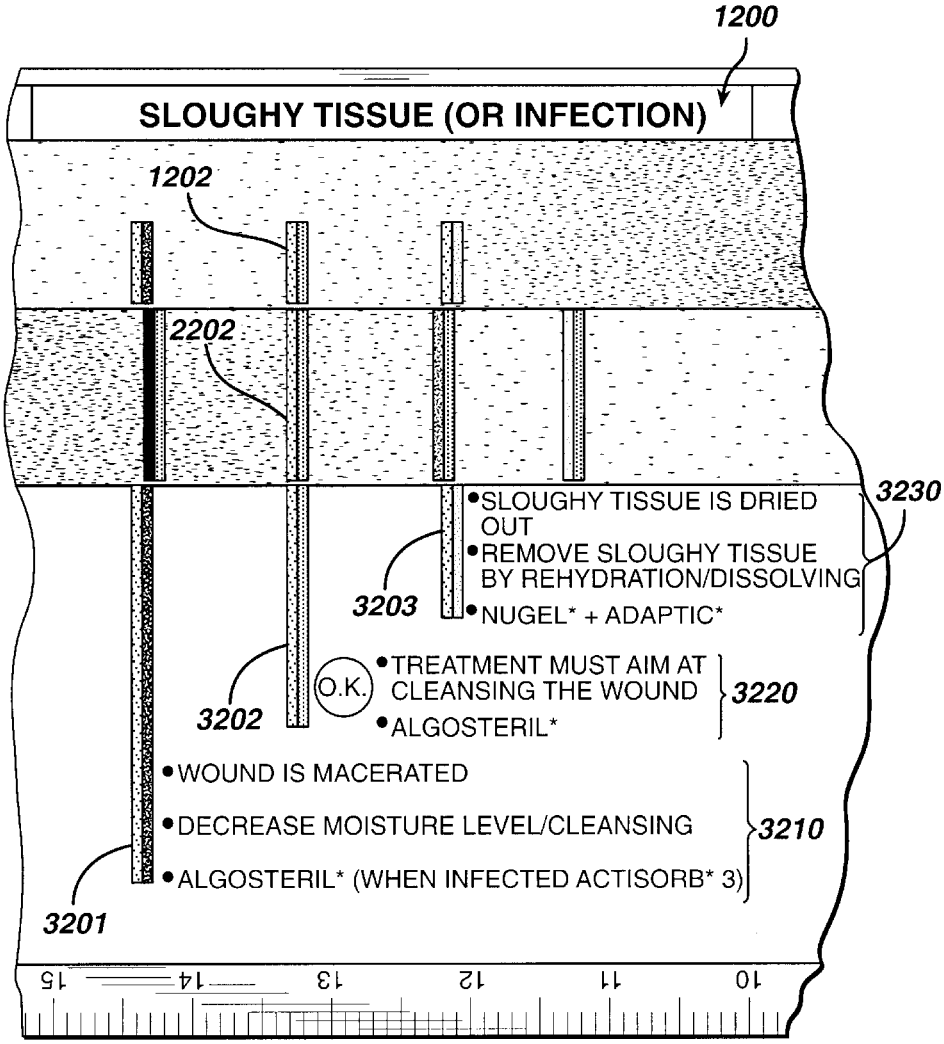
FIG. 3 depicts an enlargement of the device of this invention concerning the treatment regiment for wounds in the sloughy tissue (or infection) condition.

Referring to FIG. 3 which relates to the sloughy tissue or infection wound condition, fixed member 3000 contains indicators 3201, 3202, and 3203. Indicator 3201 refers to a wound in the infection and wet condition. Close to indicator 3201 is treatment descriptor 3210 which describes the healing and moisture condition of the wound along with the prescribed treatment. Thus treatment descriptor 3210 describes the wound as being macerated, recommends the treatment of decreasing moisture level and/or cleaning, and recommends wound care dressings suitable for such treatment and in this instance Johnson & Johnson wound care dressings of ALGOSTERIL and when infected ACTISORB3. Treatment descriptor 3220 located near indicator 3202, describes the wound condition as being OK and recommends a treatment aimed at cleansing the wound and in this instance the use of Johnson & Johnson's ALGOSTERIL wound dressing. Finally, treatment descriptor 3230, located near indicator 3203, describes the sloughy tissue as being dried out, recommends removal of sloughy tissue by rehydration/dissolving, and recommends, in this instance, treatment with Johnson & Johnson NUGEL and ADAPTIC products.

In operation, the depiction of FIG. 3 demonstrates the alignment of indicators 1202, 2202, and 3203 which indicate the treatment regiment for a wound in the sloughy tissue or infection condition and a moist moisture condition. Similarly alignment of the other indicators provide the instructions for the appropriate treatment regiment.

Figure 4:
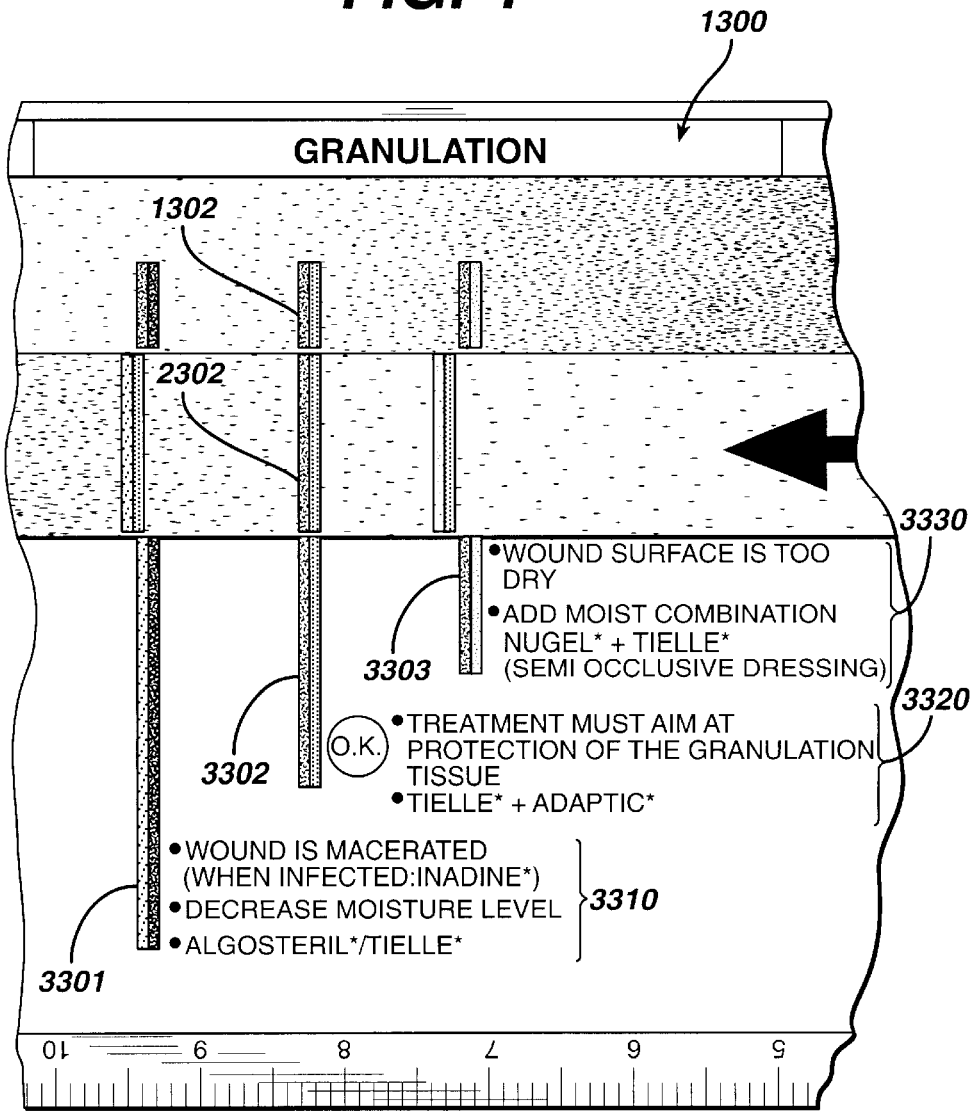
FIG. 4 depicts an enlargement of the device of this invention concerning the treatment regiment for wounds in the granulation condition.

Referring to FIG. 4 which relates to a granulating wound condition, fixed member 3000 contains indicators 3301, 3302, and 3303. Indicators 3301 refers to a wound in the granulation and wet condition. Close to indicator 3301 is treatment descriptor 3310 which describes the healing and moisture condition of the wound along with the prescribed treatment. Thus treatment descriptor 3310 describes the wound as being macerated, recommends the treatment of decreasing moisture level, and recommends suitable wound care dressings suitable for such treatment and in this instance Johnson & Johnson wound care dressings of ALGOSTERIL and/or TIELLE (generically, a semi-permeable hydropolymer dressing). Also, when the wound is infected under this condition, use of Johnson and Johnson's INADINE (generically, a non-adherent, povidone iodine impregnated wound dressing) wound dressing is recommended. Treatment descriptor 3320 located near indicator 3302, describes the wound condition as being OK and recommends a treatment aimed at protection of granulation tissue of the wound and in this instance the use of Johnson & Johnson's TIELLE and/or ADAPTIC dressings. Finally, treatment descriptor 3330 located near indicator 3303, describes the granulation tissue as being too dry recommends using a semi-occlusive dressing and, in this instance, treatment with a combination of Johnson & Johnson NUGEL and TIELLE products.

In operation, the depiction of FIG. 4 demonstrates the alignment of indicators 1302, 2302, and 3302 which indicates the treatment regiment for a wound in the granulation condition and a moist moisture condition. Similarly alignment of the other indicators provide the instructions for the appropriate treatment regiment.

Figure 5:
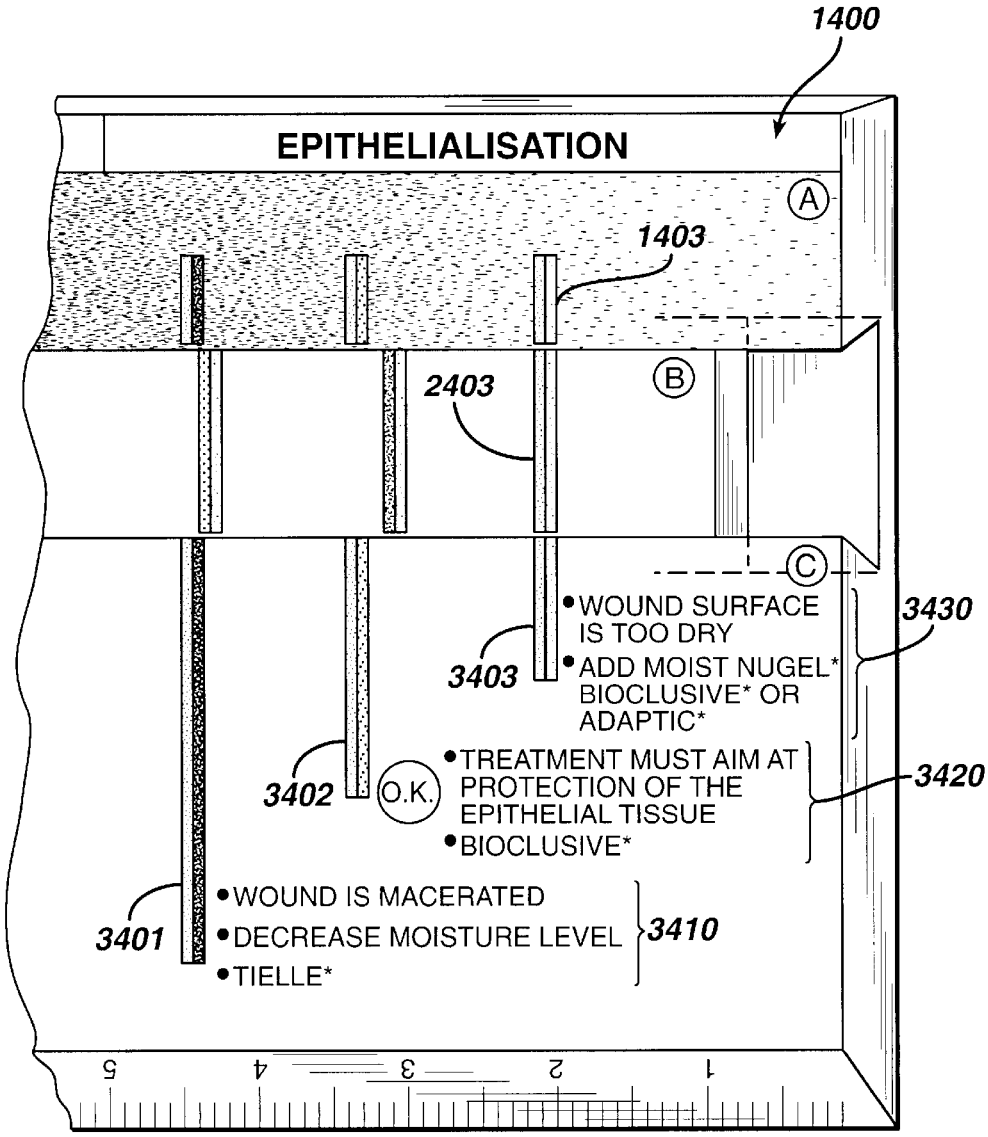
FIG. 5 depicts an enlargement of the device of this invention concerning the treatment regiment for wounds in the epithelialisation condition.
Figure 6:
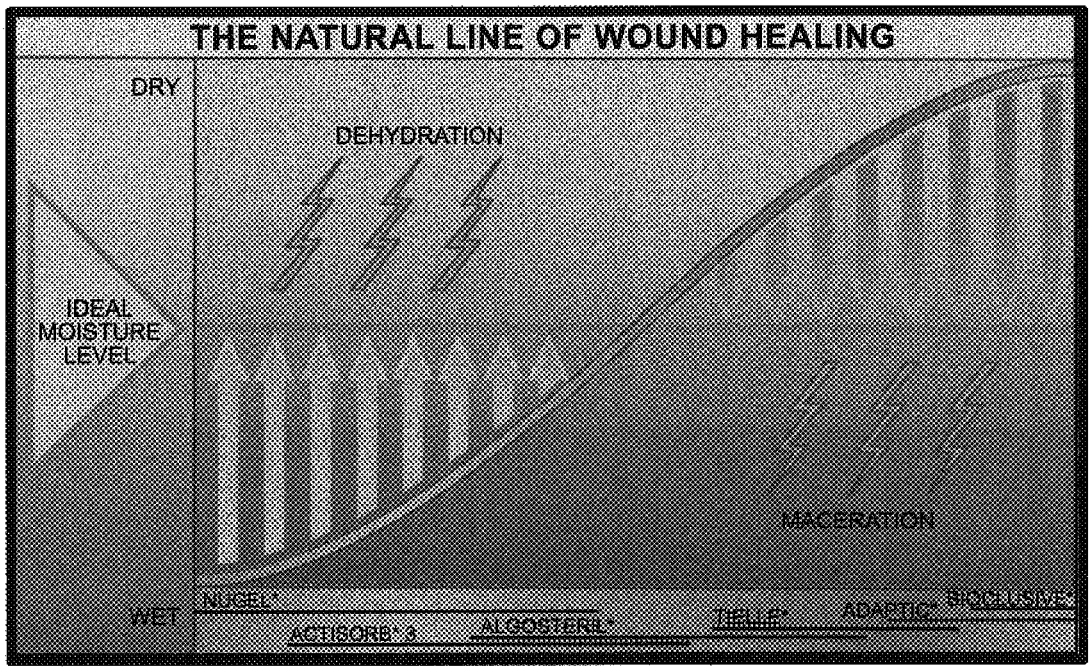
FIG. 6 PRIOR ART
FIG. 6 depicts a prior art color graphical format for the treatment of chronic wounds based on the healing phase and moisture content of the wound.
Figure 7:
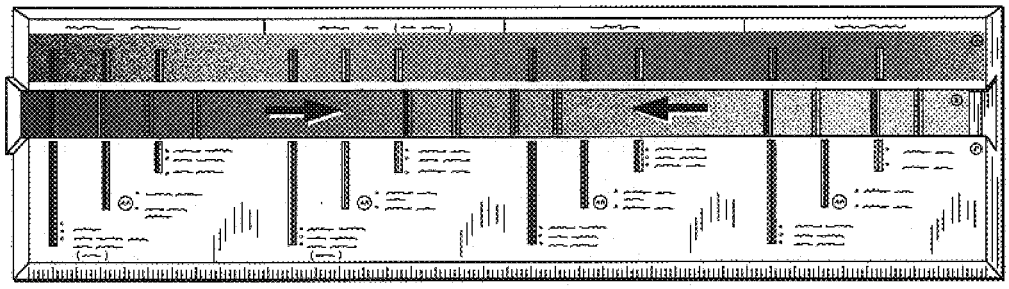
FIG. 7 depicts an overall view of the device of this invention in the invention's preferred color scheme.

Referring to FIG. 5 which relates to the epithelialization condition, fixed member 3000 contains indicators 3401, 3402, and 3403. Indicator 3401 refers to a wound in the epithialization and wet condition. Close to indicator 3401 is treatment descriptor 3410 which describes the healing and moisture condition of the wound along with the prescribed treatment. Thus treatment descriptor 3410 describes the wound as being macerated, recommends the treatment of decreasing moisture level and recommends suitable wound care dressings suitable for such treatment and in this instance Johnson & Johnson wound care dressing of TIELLE. Treatment descriptor 3420 located near indicator 3402, describes the wound condition as being OK and recommends a treatment aimed at protection of the epithelial tissue and in this instance the use of Johnson & Johnson's BIOCLUSIVE (generically, a transparent film dressing) wound dressing. Finally, treatment descriptor 3430, located near indicator 3403, describes the wound surface as being too dry and recommends, in this instance, treatment with Johnson & Johnson's NUGEL, BIOCLUSIVE or ADAPTIC products.

In operation, the depiction of FIG. 5 demonstrates the alignment of indicators 1403, 2403, and 3403 which indicates the treatment regiment for a wound in the epithialising tissue condition and a dry moisture condition. Similarly alignment of the other indicators provide the instructions for the appropriate treatment regiment.

In a preferred embodiment, indicators 3101 to 3103, 3201 to 3203, 3301 to 3303, and 3401 to 3403 are comprised of two side-by-side colored bars indicated by TABLE 3.

TABLE 3

| Indicator | Left Colored Bar | Right Colored Bar |
|---|---|---|
| 3101 | Black | Blue |
| 3102 | Black | Green |
| 3103 | Black | Yellow |
| 3201 | Yellow | Blue |
| 3202 | Yellow | Green |
| 3203 | Yellow | Yellow |
| 3301 | Red | Blue |
| 3302 | Red | Green |
| 3303 | Red | Yellow |
| 3401 | Pink | Blue |
| 3402 | Pink | Green |
| 3403 | Pink | Yellow |

Desirably, the device, when using a color scheme contains a color calibration reference to correct for coloring variations resulting from the use of various brands of photographic films as well as different types of light will give rise to different colors after reproduction. Therefore by using the three basic colors of the spectrum, blue, red, and yellow, during the photographic production of the device, color faults can be corrected for.

Also, the device of this invention may take the form of pocket-sized slide rule or a larger poster-sized device amenable to instructing potential users of the device.

In a preferred embodiment, the device of this invention contains a graduated measuring scale with which the size of the wound may be determined at the same time that the wound as being assessed for its condition, such a measuring function not only serves as an aid to properly record the size of the wound for histological purposes but also for determining the proper size of the appropriate wound dressing.

It should be understood that the foregoing disclosure and description of the present invention are illustrative and explanatory thereof and various changes in the size, shape and materials as well as in the description of the preferred embodiment may be made without departing from the spirit of the invention.

What is claimed is:

1. A device comprising a sliding member and a fixed member, the sliding member indicative of the moisture condition of a wound and the fixed member indicative of the healing phase condition of a wound and containing instructions as to the wound treatment regiment resulting from the alignment of the sliding member's particular wound moisture condition with the fixed member's particular wound healing phase condition.

2. The device of claim 1, wherein the sliding member is indicative of the wound's healing phase condition and the fixed member is indicative of the wound's moisture condition.

3. A device useful for prescribing a treatment regiment for chronic wounds comprising:

(a) a base comprising first and second elongated fixed members, the members being spaced to receive a moveable slide;

(b) the moveable slide being located between the two spaced elongated fixed members;

(c) the first of the elongated fixed members separated into regions indicating the healing phase condition of the wound in terms of whether the wound is in the necrotic condition; fibrinous slough or infection condition; granulation condition; or epithelialization condition; each of these healing phase condition regions further containing indicators corresponding to the moisture condition of the wound indicating whether the moisture level of the wound is in the wet condition; moist condition, or dry condition;

(d) the moveable slide being separated into three regions corresponding to the moisture condition of the wound in terms of whether the wound is in the wet condition, moist condition, or dry condition; each of these moisture condition regions further containing wound healing phase indicators corresponding to the healing phase condition of the wound in terms of whether the wound is in the necrotic condition; fibrinous slough or infection condition, granulation condition; or epithelialization condition; and (e) the second of the elongated fixed members comprising treatment descriptors comprising instructions for wound treatment regiments corresponding to the wound phase healing and moisture conditions which result from the alignment of the healing and moisture condition indicators of the first elongated fixed member with the healing phase and moisture condition indicators of the moveable slide.

4. The device of claim 3, wherein the wound healing phase condition regions are of the first elongated fixed member shaded or colored to distinguish the regions from among themselves.

5. The device of claim 4, wherein the wound moisture condition regions of the movable slide are shaded or colored to distinguish the regions from among themselves.

6. The device of claim 5, wherein the healing phase condition regions have the following coloring scheme of black to depict the necrotic condition, yellow to depict the fibrinous slough or infection condition, red to depict the granulation condition and pink to depict the epithialization condition.

7. The device of claim 6, wherein the wound moisture condition regions have the following coloring scheme of blue to depict a wet wound, green to depict a moist wound, and yellow to depict a dry wound.

8. The device of claim 7, wherein the moisture condition indicators of the first elongated fixed member, the wound healing phase indicators of the moveable slide, and the indicators of the second elongated fixed member are shaded or colored.

9. The device of claim 8, wherein the moisture condition indicators of the first elongated member, the wound healing phase indicators of the sliding member, and the indicators of the second elongated member each individually comprise two side-by-side colored bars.

10. The device of claim 9, wherein the indicators comprise the following left to right color scheme for the indicated wound healing and moisture conditions:

| | Left Bar | Right Bar |
|---|---|---|
| (a) FIRST ELONGATED FIXED MEMBER: | | |
| (i) Necrotic Condition: | | |
| wet (1101) | black | blue |
| moist (1102) | black | green |
| dry (1103) | black | yellow |
| (ii) Fibrinous Slough/Infection: | | |
| wet (1201) | yellow | blue |
| moist (1202) | yellow | green |
| dry (1203) | yellow | yellow |

-continued

| | Left Bar | Right Bar |
|---|---|---|
| (iii) Granulation Condition: | | |
| wet (1301) | red | blue |
| moist (1302) | red | green |
| dry (1303) | red | yellow |
| (iv) Epithelialization Condition: | | |
| wet (1401) | pink | blue |
| moist (1402) | pink | green |
| dry (1403) | pink | yellow; |
| (b) MOVEABLE SLIDE: | | |
| (i) Wet Condition: | | |
| necrotic (2101) | blue | black |
| fibrinous slough/infection (2102) | blue | yellow |
| granulation (2103) | blue | red |
| epithelialization (2104) | blue | pink |
| (ii) Moist Condition: | | |
| necrotic (2201) | green | black |
| fibrinous slough/infection (2202) | green | yellow |
| granulation (2203) | green | red |
| epithelialization (2204) | green | pink |
| (iii) Dry Condition: | | |
| necrotic (2201) | yellow | black |
| fibrinous slough/infection (2202) | yellow | yellow |
| granulation (2203) | yellow | red |
| epithelialization (2204) | yellow | pink; and |
| (c) SECOND ELONGATED FIXED MEMBER: | | |
| (i) Necrotic Condition: | | |
| wet (3101) | black | blue |
| moist (3103) | black | green |
| dry (3103) | black | yellow |
| (ii) Fibrinous Slough/Infection: | | |
| wet (3201) | yellow | blue |
| moist (3202) | yellow | green |
| dry (3203) | yellow | yellow |
| (iii) Granulation Condition: | | |
| wet (3301) | red | blue |
| moist (3302) | red | green |
| dry (3303) | red | yellow |
| (iv) Epithelialization Condition: | | |
| wet (3401) | pink | blue |
| moist (3402) | pink | green |
| dry (3403) | pink | yellow. |

11. A method for prescribing a treatment regiment for a wound comprising the steps of:

(a) assessing the wound healing phase condition;

(b) assessing the wound moisture condition; (c) providing a device comprising at least two fixed members and a sliding member, the first of the fixed members representing the wound healing condition, the sliding member representing the wound moisture condition, and the second of the fixed members comprising wound treatment instructions;

(d) aligning the moisture condition of the sliding member with the wound healing phase condition of the first fixed member corresponding to the assessed wound healing phase and moisture condition and then prescribing the wound treatment regiment indicated on the second fixed member resulting from the alignment of the sliding member and the first fixed member.

* * * * *